United States Patent [19]

Yasunaka et al.

[11] Patent Number: 4,845,847

[45] Date of Patent: Jul. 11, 1989

[54] DRY SHAVER WITH A SLIDABLE TRIMMER HANDLE

[75] Inventors: Shinsaku Yasunaka, Hikone; Keizo Ganse, Youkaichi; Hideharu Nakano, Oumihachiman, all of Japan

[73] Assignee: Matsushita Electric Works, Ltd., Japan

[21] Appl. No.: 139,632

[22] Filed: Dec. 30, 1987

[30] Foreign Application Priority Data

Jan. 14, 1987 [JP] Japan ..... 62-007494

[51] Int. Cl.[4] ..... B26B 19/20

[52] U.S. Cl. ..... 30/34.1; 30/43.92; 30/201

[58] Field of Search ..... 30/34 R, 34.1, 43.91, 30/43.92, 43, 43.1, 201, 210, 346.51

[56] References Cited

U.S. PATENT DOCUMENTS

| | | | |
|---|---|---|---|
| 2,917,824 | 12/1959 | Brauss | 30/34.1 |
| 3,780,434 | 12/1973 | de Boer et al. | 30/34.1 |
| 3,783,508 | 1/1974 | Brown et al. | 30/34.1 X |
| 3,962,783 | 6/1976 | Rentema | 30/43.92 X |
| 4,283,848 | 8/1981 | Messinger et al. | 30/34.1 |
| 4,393,585 | 7/1983 | Nagelkerke | 30/201 X |

FOREIGN PATENT DOCUMENTS

| | | |
|---|---|---|
| 0064320 | 5/1982 | European Pat. Off. . |
| 3509184 | 9/1986 | Fed. Rep. of Germany . |
| 967536 | 8/1964 | United Kingdom . |
| 2177646 | 1/1987 | United Kingdom . |

OTHER PUBLICATIONS

Official Action of German application (corresponding appln.).

*Primary Examiner*—Frank T. Yost
*Assistant Examiner*—Michael D. Folkerts
*Attorney, Agent, or Firm*—Stevens, Davis, Miller & Mosher

[57] ABSTRACT

An electric shaver has a shaving head and a trimmer handle mounting at its top a trimmer block. The trimmer handle is in the form of a flat plate slidably attached to a flat surface on the outer wall of a shaver housing for vertical movement between an inoperative position and an operative position. Formed in the inner surface of the flat plate trimmer handle is a shallow recess within which is located a trimmer drive interconnecting the trimmer block and a main drive element for the shaving head in order to drive the trimmer block from the same source as the shaving head. The trimmer block includes a stationary blade and a movable blade which define therebetween a cutting plane in parallel relation to the plane of the trimmer handle. This arrangement is to reduce the dimension of the trimmer block and the thickness of the trimmer handle. This enables the trimmer drive to be received within the thickness of the shallow recess, to greatly reduce the total thickness of the trimmer handle including the trimmer block, and therefore adding only limited thickness to the entire shaver assembly. Thus, the shaver with the trimmer handle can be made in flat configuration that is easy to handle and transport as well as to provide an aesthetic appeal by its reduced thickness.

4 Claims, 7 Drawing Sheets

DRY SHAVER WITH A SLIDABLE TRIMMER HANDLE

BACKGROUND OF THE INVENTION

1. Field of the Invention

The present invention is directed to a dry shaver with a slidable trimmer handle.

2. Description of the prior art

Dry shavers with a slidable trimmer handle have been proposed in various forms. One typical prior shaver with such trimmer handle is shown in U.S. Pat. No. 4,283,848 in which a composite slide handle is vertically movable along a shaver housing between an inoperative position and an operative position. The trimmer handle is supported to the housing with its lateral ends slidably received in corresponding guide grooves in the housing and it is provided at its top end with a pair of trimmer blades which define therebetween a cutting plane perpendicular to the plane of the trimmer handle, or which define a cutting edge therebetween directed perpendicular to the latter plane. This arrangement of the trimmer blades inevitably requires the trimmer handle to have an increased thickness for accommodating the depth dimension of the blades, which in turn adds bulk to the whole shaver assembly and makes it cumbersome to operate and transport.

SUMMARY OF THE INVENTION

In view of the above, the present invention has been accomplished to provide an improved dry shaver with a trimmer handle which has a flat configuration enough to be completely portable and provides aesthetic appeal by its reduced thickness. The dry shaver in accordance with the present invention includes a housing having a flat surface on its outer wall, a shaving head mounted on the top of the housing, and a trimmer handle mounting at its top end a trimmer block comprising a pair of trimmer blades. The trimmer handle is attached to the housing for vertical movement between an inoperative position and an operative position. A main drive means is received in the housing and is drivingly connected to the shaving head for shearing operation thereof. Included in the trimmer handle is a trimmer drive which is pivotally supported thereto at its center with its top end connected to one of the trimmer blades and with its lower end engageable with he main drive means for driving the trimmer blade in a reciprocatory manner. The improvement of the shaver is characterized in that the trimmer handle is in the form of a flat plate which is slidable along the flat surface of the housing with its inner surface in slidable contact with the flat surface so that it is movable vertically there along between the inoperative and operative positions. Formed in the inner surface of the trimmer handle of flat plate is a shallow recess for receiving the entire trimmer drive within the depth thereof. The main drive means is formed with an extension which is exposed to the flat surface of the housing for engagement with the lower end of the trimmer drive within the depth of the recess such that the drive means is operatively connected to the trimmer drive when the trimmer handle is moved into its operative position. The trimmer blades mounted on the trimmer handle define therebetween a cutting plane which is in parallel relation to the plane of the trimmer handle so that the trimmer blades are aligned in the thickness of the trimmer handle of flat plate, contributing to reducing the thickness of the whole trimmer handle including the trimmer block and therefore giving rise to a compact arrangement with respect to the total thickness of the shaver including the trimmer handle, while using the trimmer handle of simple configuration.

Accordingly, it is a primary object of the present invention to provide a dry shaver with a trimmer handle which is shaped into a more flat configuration enough to be easily handled and carried with, and provides an aesthetic appeal by its reduced thickness.

The trimmer handle is formed on its inner surface with a pair of laterally spaced hooks which project into the housing through corresponding vertical grooves formed in the lateral ends of the flat surface. One of the hooks is engaged with a slider switch which is vertically movable in the housing together with the flat handle plate so as to energize and deenergize the main drive means, while the other hook is engaged with a slider latch which is movable vertically within the housing in a stepped manner so that the flat handle plate is given a stepped movement between said inoperative position and said operative position. In this manner, the hooks attaching the trimmer handle to the housing are best utilized to give additional but required functions to the trimmer handle.

It is therefore another object of the present invention to provide a dry shaver with a trimmer handle in which the trimmer handle is slidably attached to the shaver housing by means of hooks capable of performing the other functions required for the operation of the trimmer handle.

In a preferred embodiment, the flat handle plate is made movable stepwise between a plurality of vertical positions in each of which the trimmer block is drivingly connected to the main drive means for enabling the trimmer operation simultaneously with the shaving head. The plurality of vertical positions includes a lower position in which the cutting edge of the trimmer block is located below the apex of the shaving head while being in a cooperative shearing relation with the shaving head, an upper position in which the cutting edge of the trimmer block projects far above the apex of the shaving head to such an extent that the trimmer block can be utilized without being substantially interfered with by the shaving head, and an intermediate position in which the edge of the trimmer blade is located just above the apex of the shaving head while being in a cooperative shearing relation therewith. Thus, the user can select any one of these positions depending upon a particular hair area intended to be trimmed for performing effective and convenient cutting operations either alone or in association with the shaving head. Particularly, the lower and medium positions are useful for shaving a close cut to a relatively long or twisted hair since the trimmer can be utilized to move along the skin in advance of the shaving head in order to cut such hair to a length it is acceptable by the following shaving head. It is therefore a further object of the present invention to provide a dry shaver in which a trimmer handle can assume a plurality of operative positions having different cutting relationships with respect to the shaving head so that the user can select a suitable one among the different cutting modes depending upon a particular hair area.

For providing a consistent reciprocatory movement to the trimmer blade irrespective of the vertical positions of the trimmer handle, the extension of the main drive means is in the form of a vertically elongated member reciprocating in the lateral direction of the trimmer handle to give an equal amount of reciprocatory movement along its length. Thus, the trimmer drive engaged with the extension at varying points along the length of the extension with the varying positions of the trimmer handle can transmit an equal amount of reciprocation to the trimmer blade.

It is therefore a still further object to provide a dry shaver with a trimmer handle in which the trimmer blade can have a plurality of vertically spaced operative positions with respect to the shaving head, while assuring the same cutting stroke to the trimmer blade irrespective of the vertical positions selected.

These and other objects and advantages will become apparent from the following description of the preferred embodiment of the present invention when taken in conjunction with the accompanying drawings.

DESCRIPTION OF THE PREFERRED EMBODIMENT

Figure 1:
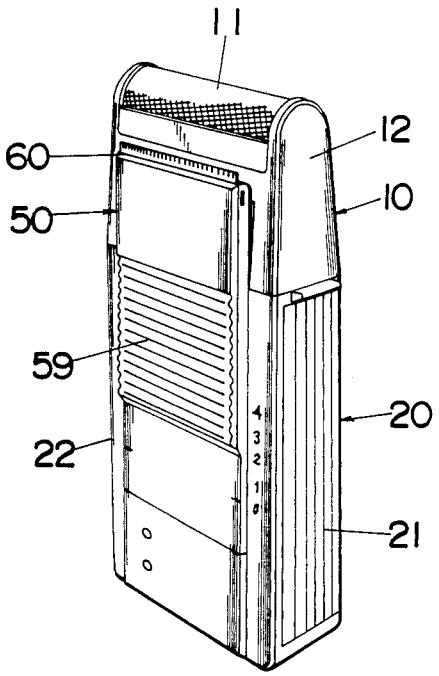
FIG. 1 is a perspective view of a dry shaver with a trimmer handle in accordance with a preferred embodiment of the present invention.
Figure 2:
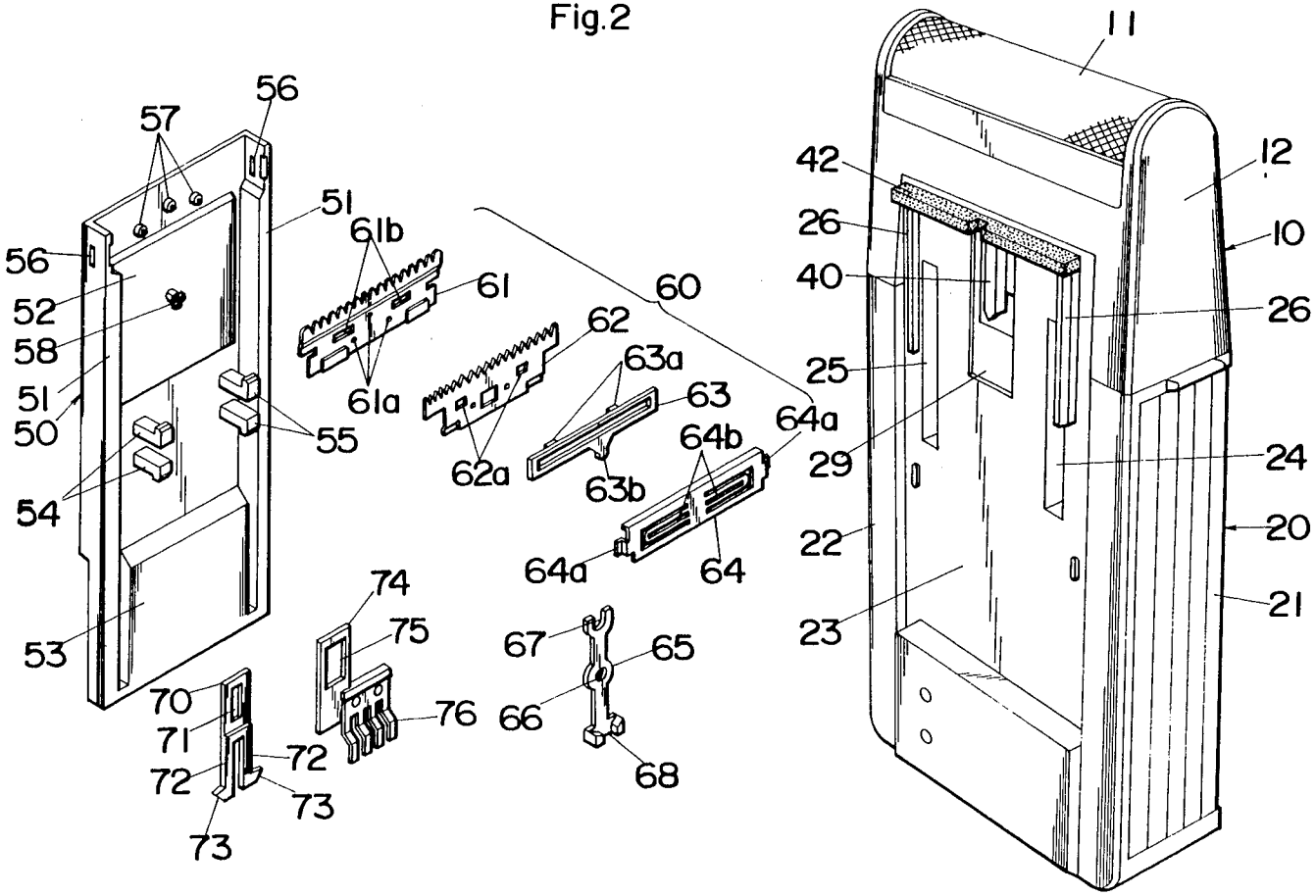
FIG. 2 is an exploded perspective view of the shaver.

Referring now to FIGS. 1 and 2, there is shown an electric dry shaver in accordance with a preferred embodiment of the present invention. The shaver comprises a shaving head 10 detachably mounted on a housing 20 and a trimmer handle 50 vertically slidable along the outer wall of the housing 20. The housing 20 is a flat-shaped generally rectangular member having wide side walls 21 and narrow end walls 22. One of the wide side walls 21 defines therein a slightly recessed flat surface 23 along which the trimmer handle 50 is slidable for movement between a lowermost inoperative position and upper plural operative positions.

Figure 3:
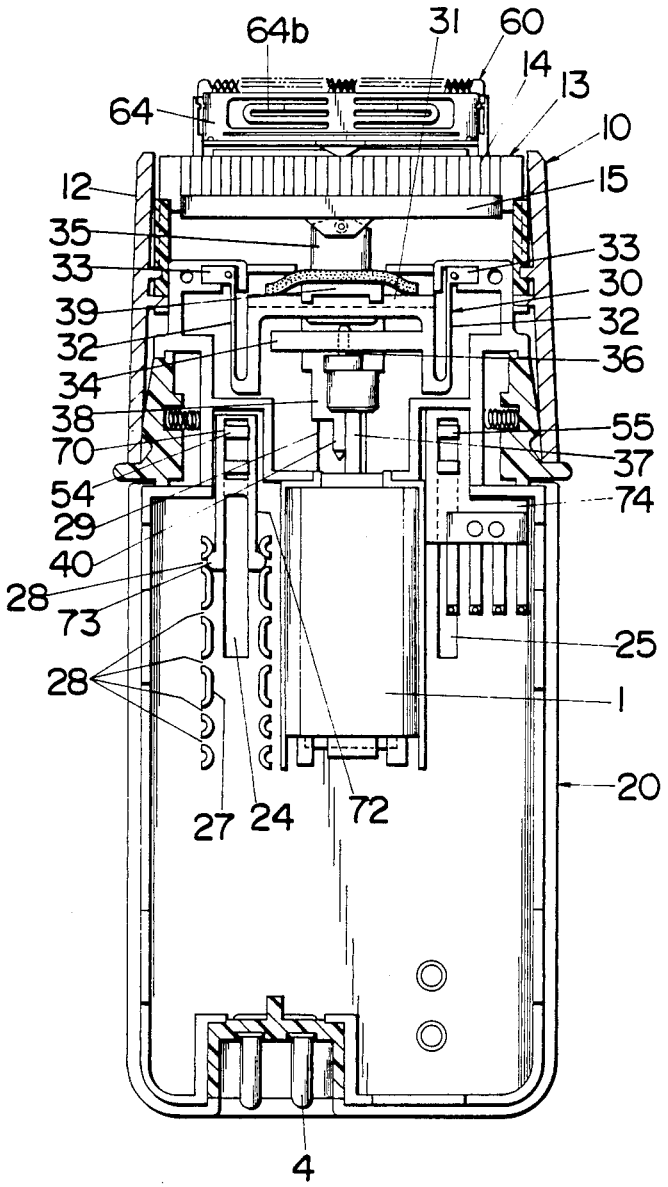
FIG. 3 is a front view, partly in section, of the shaver showing structure with its several parts removed therefrom.
Figure 4:
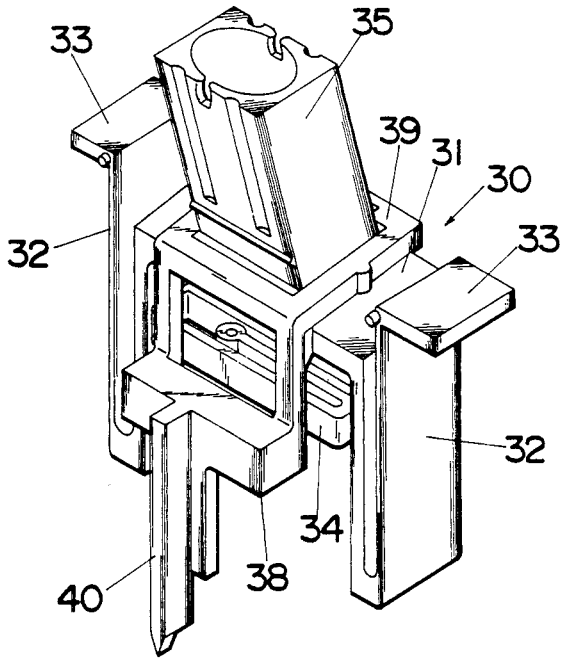
FIG. 4 is a perspective view of a main drive for imparting a movement to a shaving head and a trimmer block.
Figure 5:
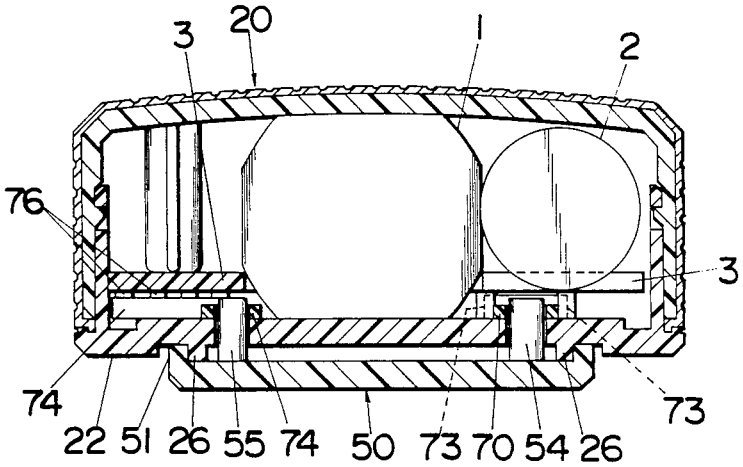
FIG. 5 is a horizontal section of the shaver.
Figure 6:
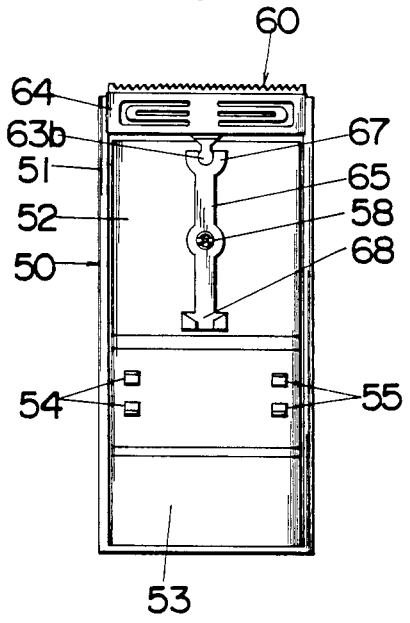
FIG. 6 is rear view of the trimmer handle showing a trimmer drive included therein.

The shaving head 10 includes a shearing foil 11 curved into a part-cylindrical configuration and supported by a head frame 12 detachable to the housing 20. Cooperative with the shearing foil 11 is an inner cutter assembly 13 which is driven to reciprocate along the undersurface of the shearing foil 11 for hair shearing operation. As shown in FIG. 3, the inner cutter assembly 13 comprises a number of spaced inner blades 14 carried on a block 15 which is connected through a main drive element 30 to an electric motor 1 incorporated in the housing 20 together with a rechargeable battery 2 (not seen in FIG. 3 but seen in FIG. 5). The main drive element 30 is cooperative with an eccentric shaft 36 connected to a motor output shaft 37 to translate the rotary motion of the motor into a reciprocatory motion of the inner cutter assembly 13. For this purpose, the main drive element 30 includes a rigid member 31 integrally connected through respective resilient legs 32 to end tabs 33 which are secured to the housing 20 for movably supporting the rigid member 31 within the housing 20. Also integrally formed with rigid member 31 is a horizontal member 34 which is made rigid in its lengthwise direction but resilient in the direction perpendicular thereto so that the eccentric motion of the eccentric shaft 36 connected to the horizontal member 34 is translated into only the reciprocatory motion of the rigid member 31 along its length. As shown in FIG. 4, the main drive element 30 includes an extension attachment 38 which has a ring portion 39 which snugly fits over a connector stud 35 of the rigid member 31 so that the extension attachment 38 is driven to reciprocate together therewith. The extension attachment 38 further includes a vertically extending nose 40 for driving a trimmer block of the trimmer handle 50, as will be discussed later.

Figure 7:
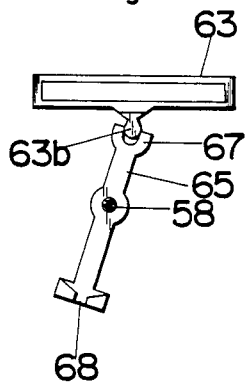
FIG. 7 is a schematic view illustrating the operation of the trimmer drive.

Turning back to FIG. 2, the trimmer handle 50 is in the form of a flat thin plate having mounted at its top end the trimmer block 60 including a stationary blade 61, a movable blade 62, a shoe 63, and a holder 64 placed in this order to the rear top end of the trimmer handle 50. Projecting slightly rearwardly from the lateral edges of the trimmer handle 50 are a pair of guide rails 51 which form between the upper portions thereof a shallow recess 52 and of which rear edges are flush with a guide contact area 53 on the lower end portion of the trimmer handle 50. The stationary blade 61 is secured to the upper end of the shallow recess 52 with integral posts 57 on the upper end of the recess 52 fitting into corresponding apertures **61*a* in the stationary blade 61. The shoe 63 carries the movable blade 62 with its projections 63*a* extending snugly through corresponding holes 62*a* of the movable blade 62. The projections 63*a* are received respectively in laterally elongated slots 61*b* in the stationary blade 61 so that the movable blade 62 is movable relative to the stationary blade 61 while keeping in axial alignment therewith. The shoe 63 has a pivot end 63*b* for driving connection to the main drive element 30 through a trimmer drive 65. The holder 64 is placed over the shoe 63 and is fixed to the trimmer handle 50 with its side flaps 64*a* engaged in complementary openings 56 in the upper end of the guide rails 51, respectively. When fixed, the holder 64 serves to bias the movable blade 62 against the stationary blade 61 by means of integral springs 64*b* formed integrally therewith. These members forming the trimmer block 60 are assembled on the inner surface of the trimmer handle 50 within the thickness thereof so as not to protrude inwardly of the guide rails 51, allowing the trimmer handle 50 to be in sliding contact with the flat surface 23 only at the guide rails 51 and the guide contact area 53. Integrally formed on the bottom of the recess 52 is a split boss 58 which projects into a center hole 66 of the trimmer drive 65 to pivotally support the same within the depth of the recess 52. The trimmer drive 65 is formed at its upper end with a catch 67 for pivotal engagement with the pivot end 63*b* of the shoe 63 and is formed at its lower end with a pocket 68 engageable with the nose 40 of the main drive element 30 extending in an opening 29 at the upper end of the flat surface 23** of the housing 20. When the pocket 68 is engaged with the main drive element 30, the trimmer drive 65 is driven to move to and from about its center, causing the shoe 63 and the movable blade 62 to reciprocate together with the inner cutter assembly 13, as shown in FIG. 7.

Figure 8:
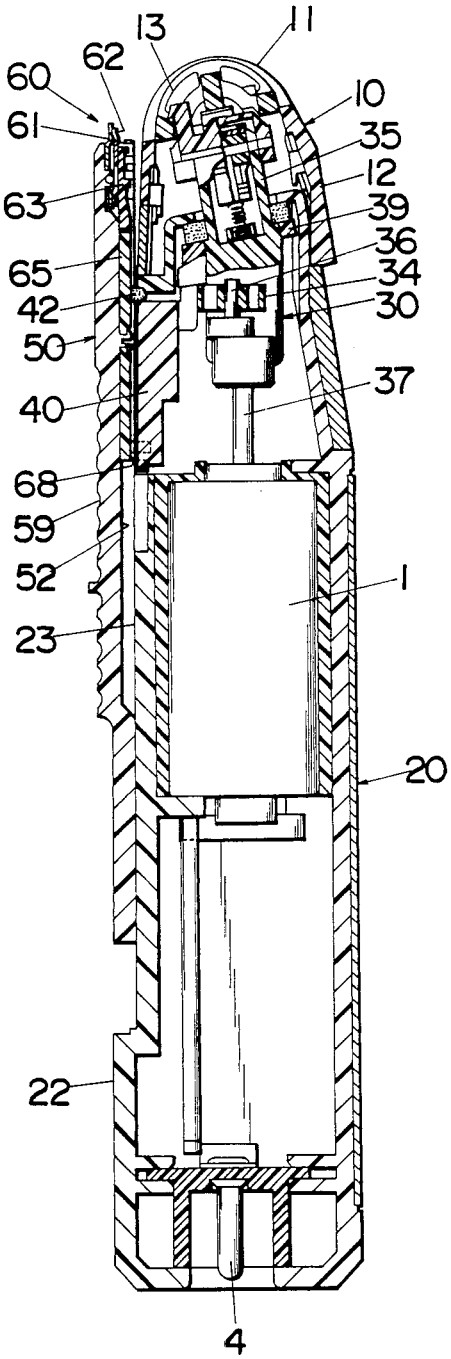
FIG. 8 is a vertical section of the shaver with the trimmer handle shown in its lower operative position.
Figure 9:
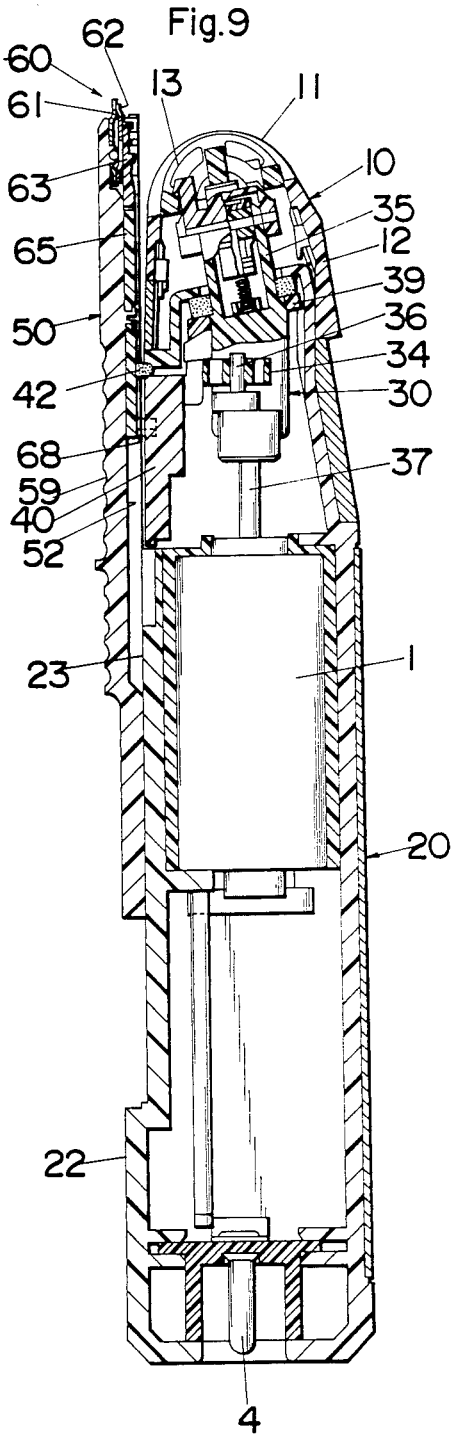
FIG. 9 is a vertical section of the shaver with the trimmer handle shown in its intermediate position.
Figure 10:
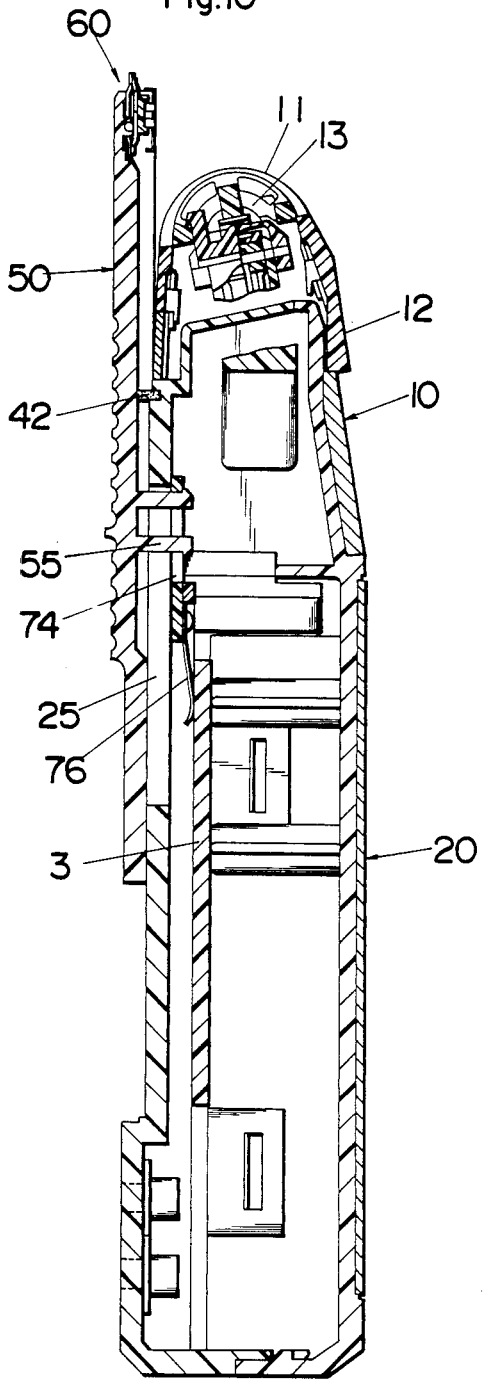
FIG. 10 is a vertical section of the shaver with the trimmer shown in its upper operative position similar to FIGS. 8 and 9 but shown in a different section.

The trimmer handle 50 includes a pair of integral hooks 54 and 55 extending rearwardly from the lateral ends thereof and projecting through corresponding vertical grooves 24 and 25 respectively formed in the flat surface 23 of the housing 20. Each of the hooks 54 and 55 is secured within the housing 20 to each of a slider latch 70 and a slider switch 74 to attach the trimmer handle 50 slidably on the flat surface 23. As shown in FIGS. 2 and 3, the slider latch 70 has a ring 71 into which the hook 54 extends for locked engagement therewith, while the slider switch 74 has a ring 75 for locked engagement with the hook 55. The slider switch 74 includes contact springs 76 which are brought into contact with complementary conductors (not shown) on a board 3 mounted in the housing 20 to connect the motor 1 and the battery 2 when the trimmer handle 50 is moved from its lowermost position upwardly to its operative position. The board 3 carries a number of circuit forming parts including the battery 2 and a charging socket 4. The slider latch 70 includes a pair of resilient legs 72 each having a detent 73 at its lower end. Cooperative with the detents 73 of the slider latch 70 are a series of vertically spaced stop recesses 28 which are formed in ribs 27 integrally projecting inwardly of the housing 20 and each of which is capable of retaining the detents 73 during the vertical movement of the trimmer handle 50 for providing a stepwise movement to the trimmer handle 50. These stop recesses 28 are provided five in number and vertically spaced at different pitches to determine the corresponding vertical positions at which the trimmer handle 50 is retained. These positions define, starting upwardly from a lowermost position, an OFF-position, a 1st-ON position, a 2nd-ON position, 3rd-ON position, a 4th-ON position, and a 5th-ON position. At the OFF-position, the motor 1 is disconnected from the battery 2, while it is energized to reciprocate the main drive element 30 at any one of the remaining ON positions for shearing operation by the shaving head 10. It is not until the trimmer handle 50 advances to its 2nd-ON position that the trimmer drive 65 is engaged at its pocket 68 with the nose 40 of the main drive element 30 for simultaneously reciprocating the movable blade 62. The trimmer drive 65 is kept engaged with the nose 40 at any one of the 2nd, 3rd, and 4th-ON positions for operating the trimmer at that position. It is to be note at this point that since the nose 40 is a vertically elongated member driven to reciprocate with the main drive element 30 it gives the same amount of reciprocation to the trimmer drive 65 irrespective of the vertical positions at which the trimmer 'drive 65 is engaged with the nose 40, or the positions that trimmer handle 50 assumes between its 2nd and 4th ON positions, thus giving the equal amount of reciprocation to the movable blade 62 at any one of these operation positions. The outer surface of the trimmer handle 50 is horizontally knurled as at 59 to facilitate the vertical movement of the trimmer handle 50 by the finger of the user. The trimmer handle 50 thus attached to the housing 20 by means of the hooks 54 and 55, the guide rails 51 and the lower guide contact area 53 are brought into slidable contact with the flat surface 23 of the housing 20 while guide ribs 26 on the upper lateral sides of the flat surface 23 are respectively in slidable engagement with the inner edges of the guide rails 51 so as to assure a smooth sliding movement of the trimmer handle 50. When the trimmer handle 50 is moved upwardly to its 1st-ON position where the trimmer block 60 is kept inactivated, the cutting edge of the trimmer block 60 is located below the lower exposed end of the shearing foil 11, assuring the shaving head 10 to be manipulated without being interfered by the trimmer block 60. When the trimmer handle 50 is advanced to its 2nd-ON position, as shown in FIG. 8, where the trimmer block 60 is activated to be ready for its shearing operation, the cutting edge of the trimmer block 60 is in a close relation to the shearing foil 11 and located just below the apex of the latter by a distance of approximately 5 mm. At the 3rd-ON position, as shown in FIG. 9, the cutting edge is kept in a close relation but located just above the apex of the shearing foil 11 by a distance of approximately 3 mm. These two positions permits the trimmer block 60 to perform shearing in cooperation with the shaving head 10 in a single shaving stroke as shearing a long hair in advance of the shaving head 10. When the trimmer handle 50 is further advanced upwardly to its 4th-ON position, as shown in FIG. 10, the cutting edge of the trimmer block 60 goes well above the apex of the shearing foil 11 so that it can be utilized for trimming without being interfered by the shaving head 10. With this provision of activating the trimmer block in the plural vertical positions, the user can select the best position for trimming depending upon a particular hair area.

At the upper end of the flat surface 23, there is provided a horizontally extending sealing member 42 which is in contact with the inner surface of the trimmer handle 50 below the trimmer block 50 so as to fill the gap between the flat surface 23 and the trimmer handle 50, preventing the hair cuttings from entering the flat surface 23 and into the housing 20 through the grooves 24 and 25 and the opening 29.

What is claimed is:

1. A dry shaver comprising:

a housing having a flat surface on its outer wall;

a shaving head mounted on the top of the housing;

a trimmer handle slidably attached to the housing for vertical movement between an operative position and an inoperative position, said trimmer handle mounting at its top end a trimmer block comprising a pair of trimmer blades;

a main drive means received in the housing and connected to said shaving head for shearing operation thereof, a trimmer drive pivotally supported by said trimmer handle at its center with its top end connected to one of the trimmer blades and with its lower end engageable with the main drive means for driving the trimmer blade in a reciprocatory manner;

said trimmer handle being in the form of a flat plate which is slidably attached on said flat surface of the housing with the inner surface of the flat plate being in slidable contact with said flat surface so that the flat plate is movable vertically there along between said inoperative and operative positions, said flat plate being formed in its inner surface with a shallow recess for receiving said trimmer drive entirely within the depth thereof;

said trimmer blades defining therebetween a cutting plane which is in parallel relation to the plane of said flat handle plate;

said main drive means having an extension exposed to said flat surface of the housing for engagement with the lower end of said trimmer drive such that said main drive means is operatively connected to the trimmer drive when said trimmer handle is moved into its operative position;

said flat handle plate being formed on its inner surface with a pair of laterally spaced hooks which project into the housing through corresponding vertical grooves formed in the lateral ends of said flat surface, one of said hooks being engaged with a slider switch inside of the housing which is vertically movable together with said flat handle plate to energize and deenergize said main drive means, the other hook being engaged with a slider latch which is movable vertically in a stepped manner inside of the housing so that said flat handle is given a stepped movement between said inoperative position and said operative position.

2. A dry shaver as set forth in claim 1, wherein said operative position further includes a plurality of vertical positions between which said flat handle plate is movable stepwise and in each of which positions said trimmer block is drivingly connected to the main drive means for enabling the trimmer operation simultaneously with the shaving head, said plurality of vertical positions including at least a lower position in which the edge of the trimmer blade is located below the apex of said shaving head while being in a cooperative shearing relation with the shaving head and an upper position in which the edge of the trimmer blade is located above the apex of said shaving head.

3. A dry shaver comprising:

a housing having a flat surface on its outer wall;

a shaving head mounted on the top of the housing;

a trimmer handle slidably attached to the housing for vertical movement between an operative position and an inoperative position, said trimmer handle mounting at its top end a trimmer block comprising a pair of trimmer blades;

a main drive means received in the housing and connected to said shaving head for shearing operation thereof, a trimmer drive pivotally supported by said trimmer handle at its center with its top end connected to one of the trimmer blades and with its lower end engageable with the main drive means for driving the trimmer blade in a reciprocatory manner;

said trimmer handle being in the form of a flat plate which is slidably attached on said flat surface of the housing with the inner surface of the flat plate being in slidable contact with said flat surface so that the flat plate is movable vertically there along between said inoperative and operative positions, said flat plate being formed in its inner surface with a shallow recess for receiving said trimmer drive entirely within the depth thereof;

said trimmer blades defining therebetween a cutting plane which is in parallel relation to the plane of said flat handle plate;

said main drive means having an extension exposed to said flat surface of the housing for engagement with the lower end of said trimmer drive such that said main drive means is operatively connected to the trimmer drive when said trimmer handle is moved into its operative position;

wherein said flat handle plate is movable stepwise among a plurality of vertical positions in each of which the trimmer block is drivingly connected to the main drive means for enabling the trimmer operation simultaneously with the shaving head, said plurality of vertical positions including a lower position in which the edge of the trimmer blade is located below the apex of said shaving head while being in a cooperative shearing relation with the shaving head, an upper position in which the edge of the trimmer blade projects far above the apex of said shaving head to such an extent that the trimmer blade can be utilized without substantially interfered by the shaving head, and an intermediate position in which the edge of the trimmer blade is located just above the apex of said shaving head while being in a cooperative shearing relation therewith.

4. A dry shaver comprising:

a housing having a flat surface on its outer wall;

a shaving head mounted on the top of the housing;

a trimmer handle slidably attached to the housing for vertical movement between an operative position and an inoperative position, said trimmer handle mounting at its top end a trimmer block comprising a pair of trimmer blades;

a main drive means received in the housing and connected to said shaving head for shearing operation thereof, a trimmer drive pivotally supported by said trimmer handle at its center with its top end connected to one of the trimmer blades and with its lower end engageable with the main drive means for driving the trimmer blade in a reciprocatory manner;

said trimmer handle being in the form of a flat plate which is slidably attached on said flat surface of the housing with the inner surface of the flat plate being in slidable contact with said flat surface so that the flat plate is movable vertically there along between said inoperative and operative positions, said flat plate being formed in its inner surface with a shallow recess for receiving said trimmer drive entirely within the depth thereof;

said trimmer blades defining therebetween a cutting plane which is in parallel relation to the plane of said flat handle plate;

said main drive means having an extension exposed to said flat surface of the housing for engagement with the lower end of said trimmer drive such that said main drive means is operatively connected to the trimmer drive when said trimmer handle is moved into its operative position;

wherein said extension of the main drive means is a vertically elongated member which is reciprocated in the lateral direction of the flat handle plate so that said trimmer drive is given at its lower end an equal amount of reciprocatory movement from said extension irrespective of the vertical position in which the trimmer blades are driven to operate.

* * * * *